US008602127B2

(12) United States Patent
Hummes

(10) Patent No.: US 8,602,127 B2
(45) Date of Patent: Dec. 10, 2013

(54) HIGH TEMPERATURE DRILLING MOTOR DRIVE WITH CYCLOIDAL SPEED REDUCER

(75) Inventor: Olof Hummes, Wadersloh (DE)

(73) Assignee: Baker Hughes Incorporated, Houston, TX (US)

( * ) Notice: Subject to any disclaimer, the term of this patent is extended or adjusted under 35 U.S.C. 154(b) by 373 days.

(21) Appl. No.: 12/975,581

(22) Filed: Dec. 22, 2010

(65) Prior Publication Data

US 2012/0160569 A1 Jun. 28, 2012

(51) Int. Cl.
*E21B 4/02* (2006.01)
*E21B 4/00* (2006.01)

(52) U.S. Cl.
CPC ..... *E21B 4/006* (2013.01)
USPC ..... 175/106; 175/92; 175/107

(58) Field of Classification Search
USPC ..... 175/92, 106, 107; 475/162, 163
See application file for complete search history.

(56) References Cited

U.S. PATENT DOCUMENTS 2,932,992 A * 4/1960 Larsh ..... 475/176
3,021,910 A * 2/1962 Martin ..... 175/25
4,434,862 A 3/1984 Lyons
4,678,045 A 7/1987 Lyons
5,394,951 A 3/1995 Pringle et al.
5,517,464 A 5/1996 Lerner et al.
7,066,284 B2 6/2006 Wylie et al.
7,140,444 B2 11/2006 Makay
7,226,279 B2 6/2007 Andoskin et al.
7,467,673 B2 12/2008 Earles et al.
7,749,123 B2 7/2010 Miao et al.
7,854,260 B2 12/2010 Gaudette et al.
2009/0050372 A1 2/2009 Hall et al.
2009/0159281 A1 6/2009 Herrera
2009/0266618 A1 * 10/2009 Mitchell et al. ..... 175/325.7

FOREIGN PATENT DOCUMENTS

KR 100884819 B1 2/2009

* cited by examiner

*Primary Examiner* — Giovanna Wright
*Assistant Examiner* — Richard Alker
(74) *Attorney, Agent, or Firm* — Steve Rosenblatt

(57) ABSTRACT

A bottom hole assembly has a drill bit that is driven by a downhole turbine. The turbine speed is reduced by cycloidal gearing that requires no temperature sensitive seals when operating temperatures in some applications exceed 350 degrees F. The output shaft of the cycloidal gear reducer goes through a bearing before connection to the drill bit or associated reamer. The motive fluid can be the drilling mud. The bit can be driven at desired speeds such as 50-300 RPM while the speed reduction ratio can be in the order of 10 to 1 or more. This drive assembly can replace Moineau type downhole motor drivers that have temperature limitations due to use of rubber in the stators.

13 Claims, 2 Drawing Sheets

HIGH TEMPERATURE DRILLING MOTOR DRIVE WITH CYCLOIDAL SPEED REDUCER

FIELD OF THE INVENTION

The field of the invention is drives for drill bits and more particularly those that combine a high speed turbine and cycloid speed reduction gearing.

BACKGROUND OF THE INVENTION

Roller cone or PDC type drill bits typically are turned about 50-300 RPM. When driven with a downhole motor a Moineau design is typically used to rotate the bit. This progressing cavity type of a motor features a rubber stator with a metallic rotor turning in it and the circulating fluid causes shaft rotation as the progressing cavity makes the rotor attached to the bit rotate at a speed determined by the motor configuration and the flowing fluid parameters. The issue with such downhole motors is a temperature service limit of about 380 degrees F. because of the use of the rubber components. Many well environments have higher temperature so that an alternative way is needed to drive the bit in those high temperature applications.

Turbines have been used in downhole applications that turn drill bits with a gearbox for the proper output speed for the bit. Such a design is illustrated in U.S. Pat. No. 4,434,862. Applications with gearboxes have similar high temperature issues for the gearbox seal materials and lubricant performance issues. Other references that use turbines in downhole applications are U.S. Pat. Nos. 4,678,045; 5,394,951; 5,517,464 (driving a generator); U.S. Pat. No. 7,140,444 (driving a rotary cutter) and U.S. Pat. No. 7,066,284 (turbine as a driver option for a bottom hole assembly of a bit and associated reamer.

Turbine applications in the past have either not been coupled to bits or if coupled to bits employed mechanical drives that had enclosed housings and required seals that had temperature service limits akin to the progressing cavity pumps that could rotate at the desired bit speed without any speed reduction.

Cycloidal speed reduction devices have been used in the automotive industry for differentials as illustrated in U.S. Pat. No. 7,749,123. The principal has been employed as a downhole motor design in U.S. Pat. No. 7,226,279 and as part of a rotary steerable bottom hole assembly in U.S. Pat. No. 7,467,673. A Cycloidal speed reducer of a known design is illustrated in FIG. 2. An input shaft 10 is connected to a motor or driver 12. The shaft 10 is connected to the hub 14 eccentrically. A gear 16 turns with hub 14 in an eccentric manner. The gear 16 has a series of external lobes 18. A stator 20 is held fixed around the lobes 18 and has gaps 22 into which the lobes 18 enter and exit as the gear 16 rotates eccentrically. The gear 16 has a series of holes 24 through which extend rods 26 connected to the shaft 28. As the gear 16 rotates eccentrically at a high speed, the rods 26 define a movement pattern that follows the circular edges of the holes 24. As a result the shaft 28 rotates in the opposite direction from the shaft 10 and at a slower speed. The reduction rate of the cycloidal drive is obtained from the following formula, where P means the number of the ring gear pins 30 and L is the number of pins 32 on the cycloidal disc.

$$r = \frac{P - L}{L}$$

The advantage of a cycloidal drive is that it is an open transmission system that is well suited to a high temperature application since it does not require temperature sensitive seals. Since turbines typically operate at speeds well above the typical rate of drill bits it makes the coupling of a turbine drive to avoid the temperature limitations of a progressing cavity Moineau pump well suited for the use of cycloidal gearing to get a suitable output speed for the bit. The turbine exhaust can also run through the speed reducer to allow greater design flexibility in component layout in a space constrained environment. While there are some issues with cycloidal speed reducers such as vibration there are simple solutions to those issues while keeping the overall design simple and compact. Those skilled in the art will more readily appreciate the present invention by a review of the description of the preferred embodiment and the associated drawing while recognizing that the full scope of the invention is to be found in the appended claims.

SUMMARY OF THE INVENTION

A bottom hole assembly has a drill bit that is driven by a downhole turbine. The turbine speed is reduced by cycloidal gearing that requires no temperature sensitive seals when operating temperatures in some applications exceed 350 degrees F. The output shaft of the cycloidal gear reducer goes through a bearing before connection to the drill bit or associated reamer. The motive fluid can be the drilling mud. The bit can be driven at desired speeds such as 50-300 RPM while the speed reduction ratio can be in the order of 10 to 1 or more. This drive assembly can replace Moineau type downhole motor drivers that have temperature limitations due to use of rubber in the stators.

DETAILED DESCRIPTION OF THE PREFERRED EMBODIMENT

Figure 1A:
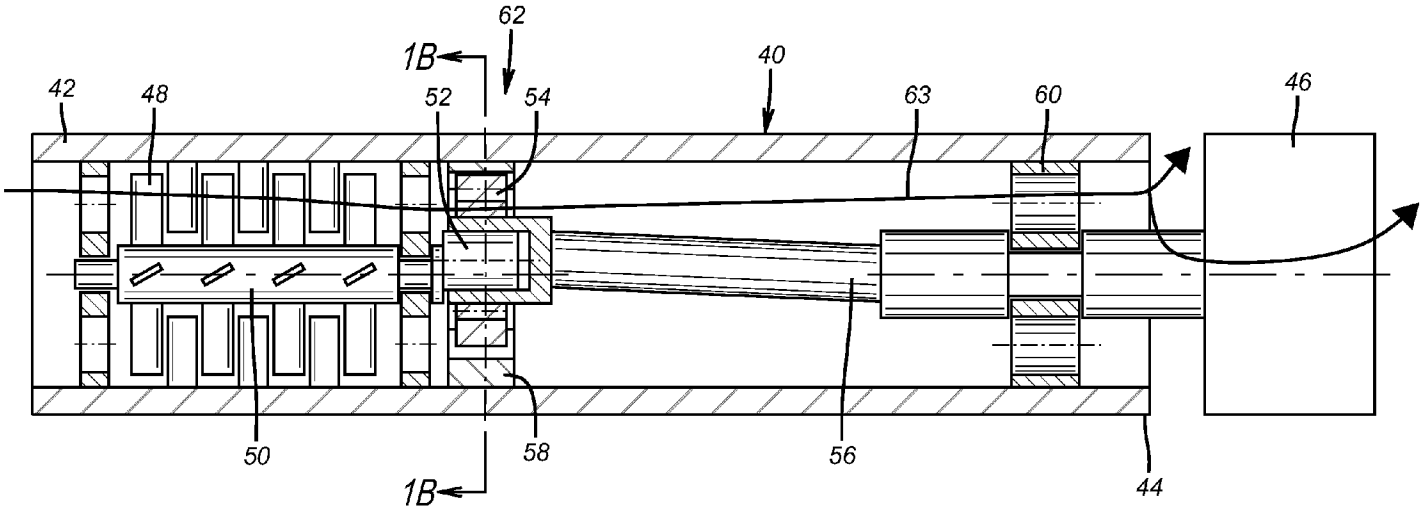
FIG. 1A is a section view of the drive system showing the turbine and the cycloidal speed reducer.
Figure 1C:
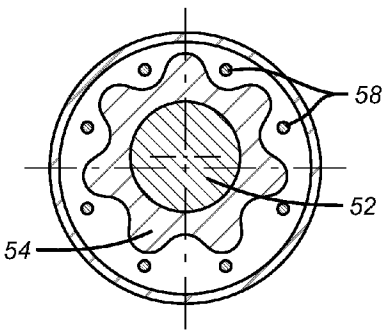
FIG. 1C is an alternative embodiment to FIG. 1B showing spaced bolts for the stator.
Figure 1B:
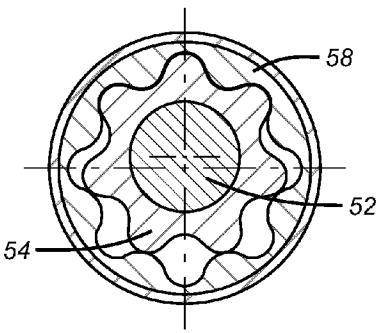
FIG. 1B is a section view through line 1B-1B of FIG. 1A.
Figure 2:
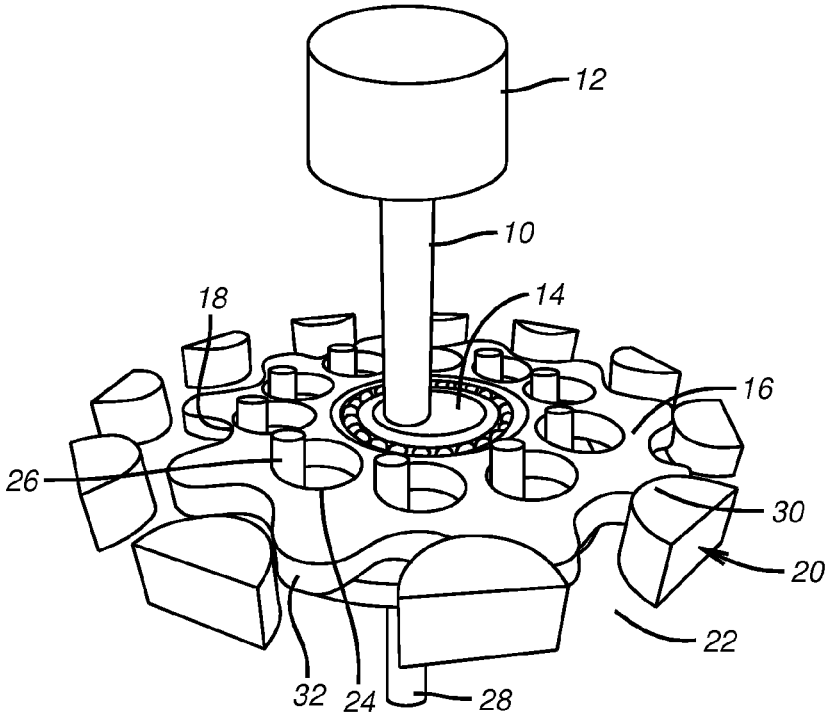
(PRIOR ART) FIG. 2

FIGS. 1A and 1B show a drive housing 40 that has an upper end 42 connected to a tubing string that is not shown. Beyond the lower end 44 of the housing 40 is a drill bit assembly or other known drilling and measurement tools schematically represented as 46. For drilling the assembly 46 can be any one of a variety of drill bit designs including an adjacent reamer. While the preferred application is to turn a downhole bit, other devices can be rotated by the drive to be described. Inside the housing 40 is a turbine 48 that can be run on a variety of fluids 63 such as gases or steam or liquids such as drilling mud. The turbine itself is a known design and features an output shaft 50 that has an end eccentric component 52 that is equivalent to shaft 10 shown in FIG. 2. The shaft stub 52 is actually also the hub for the eccentric gear 54 that is equivalent to ring 16 in FIG. 2. The output shaft 56 is equivalent to shaft 28 in FIG. 2. In the embodiment according to FIG. 1, shaft 56 is built as a flexible shaft to accommodate the eccentric motion of gear 54 and translate it back to centric rotation to drive the drill bit 46. This eliminates the plurality of pins seen as item 26 in FIG. 2, advantageously reducing the number of contact surfaces in relative motion. However, the alternative principle shown in FIG. 2, using shaft 28 and pins 26 and corresponding modification of gear 54 can be used to save assembly length and achieve a more compact design. Bearing 60 supports shaft 56 and can be one of a variety of bearing types known in the art such as friction/journal bearings or roller bearings. One of stator 58 or gear or rotor 54 can be made from a hard material such as steel or ceramic or have a carbide or diamond coated surface and the other can be made from a resilient material such as an elastomer. Alternatively both can be made of a hard material or both can be made from the resilient material. The contact surfaces between 54 and 58 can have a prismatic or helical design. Rotor 54 has a cycloidal profile and the stator 58 comprises a circular pattern of spaced bolts as shown in FIG. 1C that are ceramic, steel, carbide or diamond coated material.

The exhaust of drive fluid 63 that comes into the turbine 48 from the upper end 42 of housing 40 can be directed to exit laterally before the cycloidal gear reduction assembly 62 or in the case of drilling mud the exhaust can go through the assembly 62 or through the bearing 60 and down to the bit assembly 46 while taking away cuttings from the drilling operation.

The large tolerances that can be used in a cycloidal gear reduction assembly mean that it can remain functional even after it has become somewhat worn from use. Because there is no need to seal off fluid pressure in this system the components can be of wear resistant materials and the tolerances and moving part clearances can be relatively larger than in past systems.

Other devices in a drilling environment can be turbine driven through a cycloidal reduction gearing described above. While presenting some technical challenges the cycloidal gearing system can also be used as a speed increaser so that a low speed positive displacement motor will drive a shaft such as 56 and the resultant faster output will be obtained at a shaft such as 50 that can be tied to a generator that needs higher rotational speeds than a drill bit.

The above description is illustrative of the preferred embodiment and many modifications may be made by those skilled in the art without departing from the invention whose scope is to be determined from the literal and equivalent scope of the claims below.

I claim:

1. A drive for a subterranean bit that forms a borehole that can be used in high temperature environments, comprising:

a housing having an end connection for coupling to a tubing string;

a turbine in said housing, said turbine having an output shaft with an eccentric end component;

a cycloidal speed reducer driven by said end component in a single engagement with said end component, said cycloidal speed reducer comprising a flexible speed reducer output shaft, said output shaft extending from said single engagement through a bearing spaced from said end component, said speed reducer output shaft accommodating eccentric motion of said cycloidal speed reducer to translate said eccentric motion back to centric rotation aligned with an axis of said housing to drive the bit;

said turbine operated by fluid delivered to said housing from the string.

2. The drive of claim 1, wherein:

said turbine runs on drilling mud delivered to said housing.

3. The drive of claim 2, wherein:

said drilling mud flows through said cycloidal speed reducer after exiting said turbine.

4. The drive of claim 3, wherein:

said drilling mud flows to the bit after exiting said cycloidal speed reducer.

5. The drive of claim 2, wherein:

said drilling mud bypasses said cycloidal speed reducer after exiting said turbine.

6. The drive of claim 5, wherein:

said drilling mud flows to the bit after exiting said cycloidal speed reducer.

7. The drive of claim 1, wherein:

said cycloidal speed reducer has a speed reduction ratio of up to 10:1.

8. The drive of claim 1, wherein:

said bearing comprises one of friction/journal or roller bearing.

9. The drive of claim 1, wherein:

said cycloidal speed reducer comprises a rotor and a stator that are made of the same or different materials.

10. The drive of claim 9, wherein:

said differing materials comprise on one hand a hard steel or ceramic or a carbide or diamond coated surface and, on the other hand, can be made from a resilient elastomer.

11. The drive of claim 9, wherein:

said same materials comprise a hard steel or ceramic or a carbide or a diamond coated surface or a resilient elastomer.

12. The drive of claim 9, wherein:

contact surfaces between said rotor and said stator have a helical design.

13. The drive of claim 9, wherein:

said rotor has a cycloidal profile and said stator comprises a circular pattern of spaced bolts that are ceramic, steel, carbide or diamond coated material.

* * * * *